US006650281B2

(12) United States Patent
Caille et al.

(10) Patent No.: US 6,650,281 B2
(45) Date of Patent: Nov. 18, 2003

(54) TELECOMMUNICATIONS ANTENNA INTENDED TO COVER A LARGE TERRESTRIAL AREA

(75) Inventors: Gérard Caille, Tournefeuille (FR); Yann Cailloce, Toulouse (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/895,413

(22) Filed: Jul. 2, 2001

(65) Prior Publication Data

US 2002/0005800 A1 Jan. 17, 2002

(30) Foreign Application Priority Data

Jul. 6, 2000 (FR) ..... 00 08 794

(51) Int. Cl.[7] ..... H04B 7/185; H01Q 3/22
(52) U.S. Cl. ..... 342/354; 342/373
(58) Field of Search ..... 342/373, 354, 342/356

(56) References Cited

U.S. PATENT DOCUMENTS

| | | | | |
|---|---|---|---|---|
| 3,917,998 A | | 11/1975 | Welti | |
| 4,356,461 A | * | 10/1982 | Acoraci | 333/116 |
| 4,901,085 A | * | 2/1990 | Spring et al. | 342/368 |
| 4,907,004 A | * | 3/1990 | Zacharatos et al. | 342/354 |
| 5,115,248 A | * | 5/1992 | Roederer | 342/373 |
| 5,132,694 A | | 7/1992 | Sreenivas | |
| 5,689,272 A | * | 11/1997 | Harrison et al. | 342/372 |
| 5,929,804 A | * | 7/1999 | Jones et al. | 342/354 |
| 5,955,920 A | * | 9/1999 | Reudink et al. | 330/124 D |
| 6,340,948 B1 | * | 1/2002 | Munoz-Garcia et al. | 342/373 |

FOREIGN PATENT DOCUMENTS

| | | |
|---|---|---|
| EP | 0 355 979 A2 | 2/1990 |
| EP | 0 368 121 A1 | 5/1990 |
| EP | 0 963 005 A2 | 12/1999 |
| EP | 0 963 006 A2 | 12/1999 |
| FR | 2 750 258 A1 | 12/1997 |
| WO | WO 98/50981 | 11/1998 |

OTHER PUBLICATIONS

Angelucci, A. et al., "High Performance Microstrip Networks for Multibeam and Reconfigurable Operation in Mobile Radio Systems", GLOBECOM '94, pp. 1717–1721, vol. 3, Dec. 1994.*

* cited by examiner

*Primary Examiner*—Gregory C. Issing
(74) *Attorney, Agent, or Firm*—Sughrue Mion, PLLC

(57) ABSTRACT

The invention relates to a receive (or send) antenna for a geosynchronous satellite of a telecommunications system intended to cover a territory divided into areas, the beam intended for each area being defined by a plurality of radiating elements, or sources, disposed in the vicinity of the focal plane of a reflector. The antenna includes at least one first matrix each input of which is connected to a radiating element and each output (or input) of which is connected to a corresponding input of an inverse Butler matrix by an amplifier and a phase-shifter. The phase-shifters move the areas or correct pointing errors.

12 Claims, 6 Drawing Sheets

TELECOMMUNICATIONS ANTENNA INTENDED TO COVER A LARGE TERRESTRIAL AREA

The invention relates to a telecommunications antenna which is installed on a geosynchronous satellite and is intended to relay communications over an extensive territory.

BACKGROUND OF THE INVENTION

A geosynchronous satellite which carries a send antenna and a receive antenna, each of which has a reflector associated with a multiplicity of radiating elements or sources, is used to provide communications over an extensive territory, for example a territory the size of North America. In order to be able to re-use communications resources, in particular frequency sub-bands, the territory to be covered is divided into areas and the resources are assigned to the various areas so that when one area is assigned one resource adjacent areas are assigned different resources.

Each area has a diameter of the order of several hundred kilometers, for example, and its extent is such that, to provide a high gain and sufficiently homogeneous radiation from the antenna in the area, it must be covered by a plurality of radiating elements.

FIG. 1 shows a territory 10 covered by an antenna installed on board a geosynchronous satellite and n areas $\mathbf{12}_1$, $\mathbf{12}_2$, . . . , $\mathbf{12}_n$. This example uses four frequency sub-bands f1, f2, f3, f4.

The area $\mathbf{12}_i$ is divided into several sub-areas $\mathbf{14}_1$, $\mathbf{14}_2$, etc. Each sub-area corresponds to one radiating element of the antenna. FIG. 1 shows that some radiating elements, for example the radiating element $\mathbf{14}_3$ at the center of the area $\mathbf{12}_i$, correspond to only one frequency sub-band f4, while others, like the radiating elements at the periphery of the area $\mathbf{12}_i$, are associated with a plurality of sub-bands, i.e. the sub-bands which are assigned to the adjacent areas.

FIG. 2 shows a prior art receive antenna for a telecommunications system of the above kind.

The antenna includes a reflector 20 and a plurality of radiating elements $\mathbf{22}_1$, . . . , $\mathbf{22}_N$ close to the focal plane of the reflector. The signal received by each radiating element, for example the element $\mathbf{22}_N$, is passed first through a filter $\mathbf{24}_N$ intended in particular to eliminate the (high-power) send frequency, and then through a low-noise amplifier $\mathbf{26}_N$. The signal at the output of the low-noise amplifier $\mathbf{26}_N$ is split into several parts by a splitter $\mathbf{30}_N$, possibly with coefficients that can differ from one part to another; the object of this splitting is to enable a radiating element to contribute to the formation of more than one beam. Thus an output $\mathbf{32}_1$ of the splitter $\mathbf{30}_N$ is assigned to an area $\mathbf{34}_p$ and another output $\mathbf{32}_i$ of the splitter $\mathbf{30}_N$ is assigned to another area $\mathbf{34}_Q$.

The splitters 301, . . . , 30N and the adders $\mathbf{36}_P$, . . . , $\mathbf{36}_q$ intended to define the areas are part of a device 40 referred to as a beam or pencil beam-forming network.

The beam-forming network 40 shown in FIG. 2 includes a combination of a phase-shifter 42 and an attenuator 44 for each output of each splitter $\mathbf{30}_i$. The phase-shifters 42 and the attenuators 44 modify the radiation diagram, either to correct it if the satellite has suffered an unwanted displacement or to modify the distribution of the terrestrial areas.

Also, each low-noise amplifier $\mathbf{26}_N$ is associated with another low-noise amplifier $\mathbf{26'}_N$ which is identical to it and which is substituted for the amplifier $\mathbf{26}_N$ should it fail. To this end, two switches $\mathbf{46}_N$ and $\mathbf{48}_N$ are provided to enable such substitution. It is therefore necessary to provide telemetry means (not shown) for detecting the failure and telecontrol means (also not shown) to effect the substitution.

An antenna system of the type shown in FIG. 2 includes a large number of low-noise amplifiers, phase-shifters and attenuators. A large number of components is a problem on a satellite because of their mass. Also, a large number of phase-shifters 42 and attenuators 44 causes reliability problems.

OBJECTS AND SUMMARY OF THE INVENTION

The invention significantly reduces the number of low-noise amplifiers, phase-shifters and attenuators.

To this end, a receive antenna according to the invention includes:

- at least one first Butler matrix, each input of which receives the signal from a radiating element and each output of which is associated with a low-noise amplifier in series with a phase-shifter and preferably with an attenuator,
- a second Butler matrix which is the inverse of the first Butler matrix and has a number of inputs equal to the number of outputs of the first Butler matrix and a number of outputs equal to the number of the inputs of the first Butler matrix, the outputs of the second Butler matrix being combined to form the area beams, and
- control means for controlling the phase-shifters and, where applicable, the attenuators, to correct or modify the beams.

In a Butler matrix, which is made up of 3 dB couplers, the signal at each output is a combination of the signals at all the inputs, but the signals from the various inputs have a particular phase, different from one input to another, so that the input signals can be integrally reconstituted, after passing through the inverse Butler matrix, followed by amplification and phase-shifting, and where applicable attenuation.

The number of outputs of the first Butler matrix is preferable equal to the number of inputs. In this case, the number of low-noise amplifiers is equal to the number of radiating elements, whereas in the prior art, as shown in FIG. 2, the number of low-noise amplifiers is twice the number of radiating elements. Furthermore, the number of phase-shifters is also equal to the number of radiating elements, whereas in the prior art the number of phase-shifters and attenuators is significantly greater, because the output signal of a radiating element is split and the phase-shifting and the attenuation 42, 44 are applied to each channel of the beam-forming network.

Controlling the phase-shifters in series with the low-noise amplifiers to correct or modify the beams is particularly simple in a receive antenna according to the invention.

Because Butler matrices are used, if a low-noise amplifier fails the signal is reduced uniformly at all the outputs.

To reduce the effect of an amplifier failure on the output signals, in one embodiment the low-noise amplifier which is associated with each output of the first Butler matrix includes a plurality (for example a pair) of amplifiers in parallel, for example interconnected by couplers. In this case, the degradation due to failure of only one of the two amplifiers of a pair is half or less than that if a single amplifier were associated with each output.

It can be shown that the degradation is equal to −0.56 dB if $8^{th}$ order Butler matrices are used with a pair of amplifiers in parallel associated with each output. The degradation is −0.28 dB with $16^{th}$ order Butler matrices and with a pair of amplifiers associated with each output of the first Butler matrix.

One embodiment uses a plurality of associated two-dimensional matrices, for example matrices in different planes, so that each signal received by a radiating element is distributed over n×n low-noise amplifiers, n being the order of each two-dimensional matrix. In one example n=8 and in this case each signal received by a radiating element is distributed over 64 low-noise amplifiers. In this example, if only one amplifier is associated with each output, failure of one amplifier leads to a loss of only −0.14 dB.

The invention equally applies to a send antenna with a similar structure. In this case, the inputs of the first Butler matrix receive signals to be sent and the outputs of the second Butler matrix are connected to the radiating elements. Power amplifiers are provided for send antennas instead of low-noise amplifiers, of course.

In one embodiment that applies to sending and receiving, one of the Butler matrices and the beam-forming network constitute a single device.

It is already known in the art to use a structure with two Butler matrices for send antennas in order to distribute the send power over all of the power amplifiers, but in these prior art antennas the beams are corrected or reconfigured in the manner described for receive antennas with reference to FIG. 2. Accordingly, for send antennas, the invention reduces the number of phase-shifters, and where applicable attenuators, and also simplifies their control. Moreover, for receive antennas, as indicated above, the invention reduces the number of low-noise amplifiers (compared to prior art receive antennas).

Each pair of Butler matrices preferably corresponds to several areas. It is even possible to provide a single Butler matrix for all the areas. However, to simplify manufacture, it is preferable to provide a plurality of Butler matrices. In this case, some of the radiating elements can be assigned to two different Butler matrices. In this case, failure of an amplifier associated with a Butler matrix of a pair of Butler matrices degrades the signals for all of the beams associated with the corresponding Butler matrix. On the other hand, if there is no amplifier failure for the Butler matrix of the same pair, the sub-areas corresponding to the first matrix of the pair suffer attenuation, although there is no attenuation for the sub-areas of the second matrix of the pair.

To remedy this drawback, one embodiment of the invention controls the attenuators associated with a Butler matrix adjacent a matrix at least one amplifier of which has failed, in order to homogenize the send or receive powers.

Thus the invention relates to a receive (or send) antenna for a geosynchronous satellite of a telecommunications system intended to cover a territory divided into areas, the beam intended for each area being defined by a plurality of radiating elements, or sources, disposed in the vicinity of the focal plane of a reflector, the antenna being adapted to modify the locations of the areas or to correct an antenna pointing error. The antenna includes at least one first Butler matrix, each input (or output) of which is connected to a radiating element and each output (or input) of which is connected to a corresponding input of an inverse Butler matrix via an amplifier and a phase-shifter, the outputs (or inputs) of the inverse Butler matrices being associated with a beam-forming network, and the phase-shifters are controlled to displace the areas or to correct pointing errors, the first matrix and the inverse Butler matrix distributing the energy received by each radiating element over all of the amplifiers so that the effect of failure of one amplifier is uniformly distributed over all the output signals.

There is preferably an attenuator for equalizing the gains of the amplifiers in series with each amplifier and each phase-shifter.

In one embodiment, the antenna includes at least two Butler matrices with inputs (or outputs) connected to the radiating elements and at least one of the radiating elements is connected to an input of the first Butler matrix and to an input of the second Butler matrix.

In this case, it is preferable for the radiating element associated with two Butler matrices to be connected to the inputs (or outputs) of the two matrices via a 3 dB coupler and for an analogue coupler to be provided at the corresponding outputs (or inputs) of the inverse Butler matrices.

An attenuator can also be provided in series with each amplifier and phase-shifter; if an amplifier associated with a matrix fails, the attenuator attenuates the output signals of the other Butler matrix in order to homogenize the output signals of the two matrices.

In one embodiment, amplifiers are provided in parallel between each output (input) of the first Butler matrix and each corresponding input (output) of the inverse Butler matrix, and are associated by means of 90° couplers, for example.

To correct an angular error and to repoint all the beams simultaneously, the phase-shifters preferably modify the slope of the phase front of the output signals of the first Butler matrix.

The inverse Butler matrix and the beam-forming network advantageously constitute a single system.

When an attenuator is provided in series with each amplifier, the amplifier preferably has a dynamic range less than 3 dB.

The Butler matrices are $8^{th}$ order or $16^{th}$ order matrices, for example.

In one embodiment, the antenna includes a first series of first Butler matrices disposed in parallel planes and a second series of first Butler matrices also disposed in parallel planes in a direction different from that of the first series, for example orthogonal thereto, to enable displacement of the areas or correction of pointing errors in two different directions and thus in all the directions of the area covered by the antenna.

BRIEF DESCRIPTION OF THE DRAWINGS

Other features and advantages of the invention will become apparent from the following description of embodiments of the invention, which is given with reference to the accompanying drawings, in which.

MORE DETAILED DESCRIPTION

Figure 1:
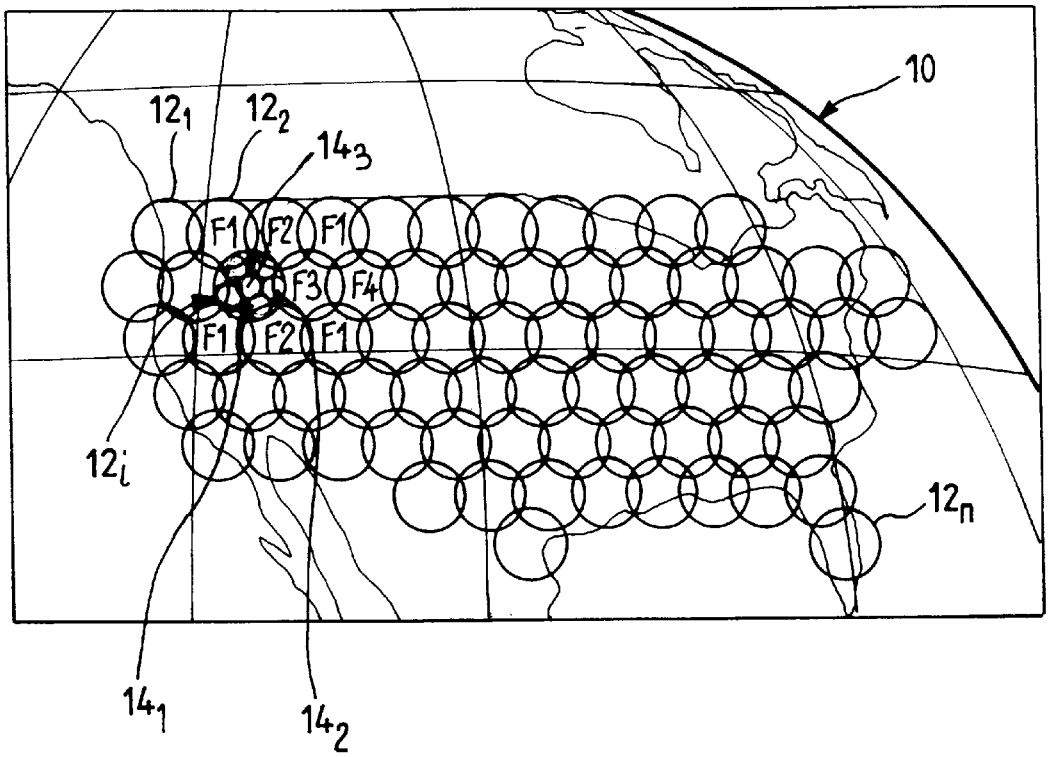
FIG. 1, already described, shows a territory divided into areas and covered by an antenna on board a geosynchronous satellite, FIG. 2, also already described, shows a prior art receive antenna.
Figure 2:
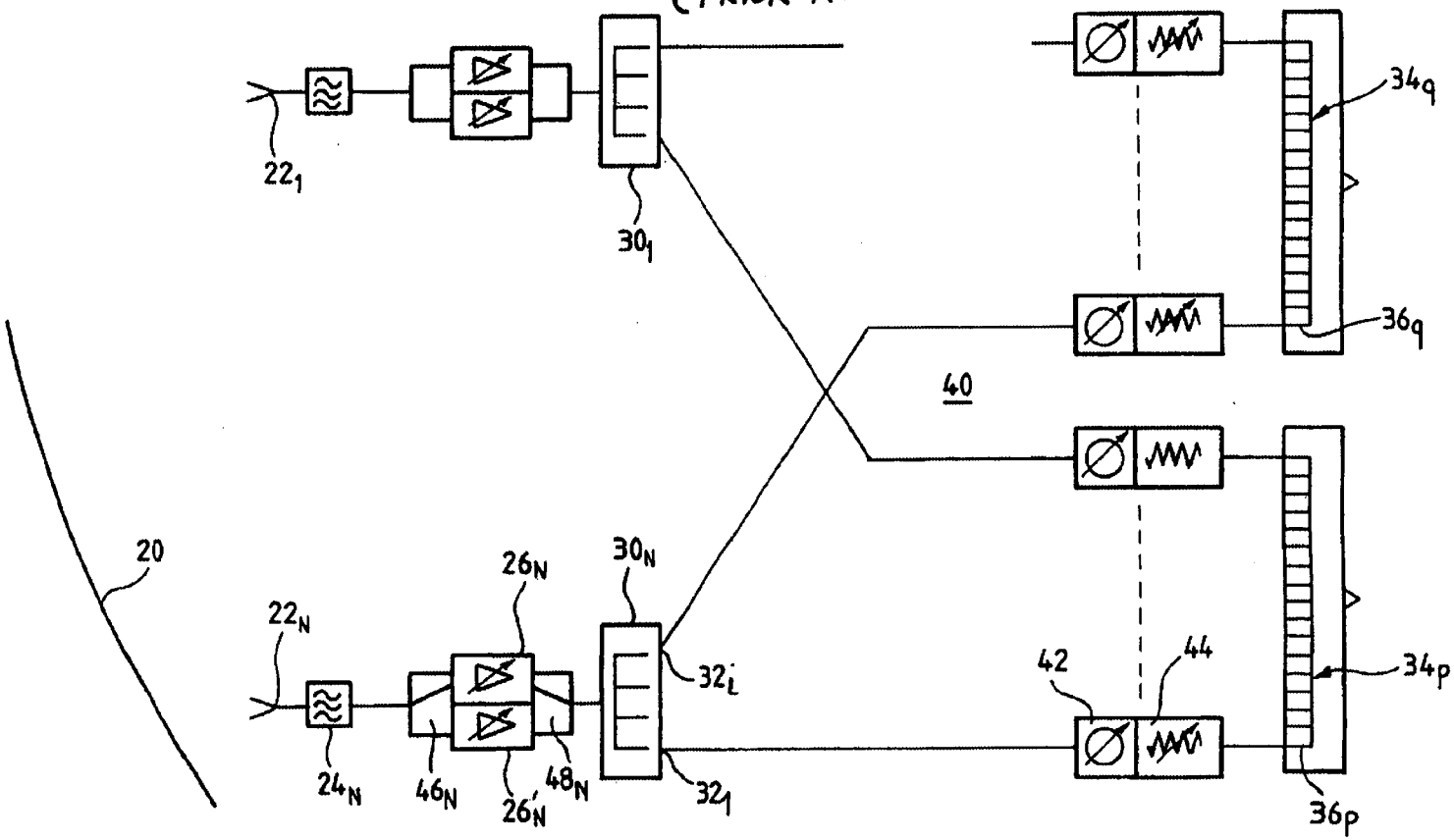
FIG 2 (PRIOR ART)
Figure 3:
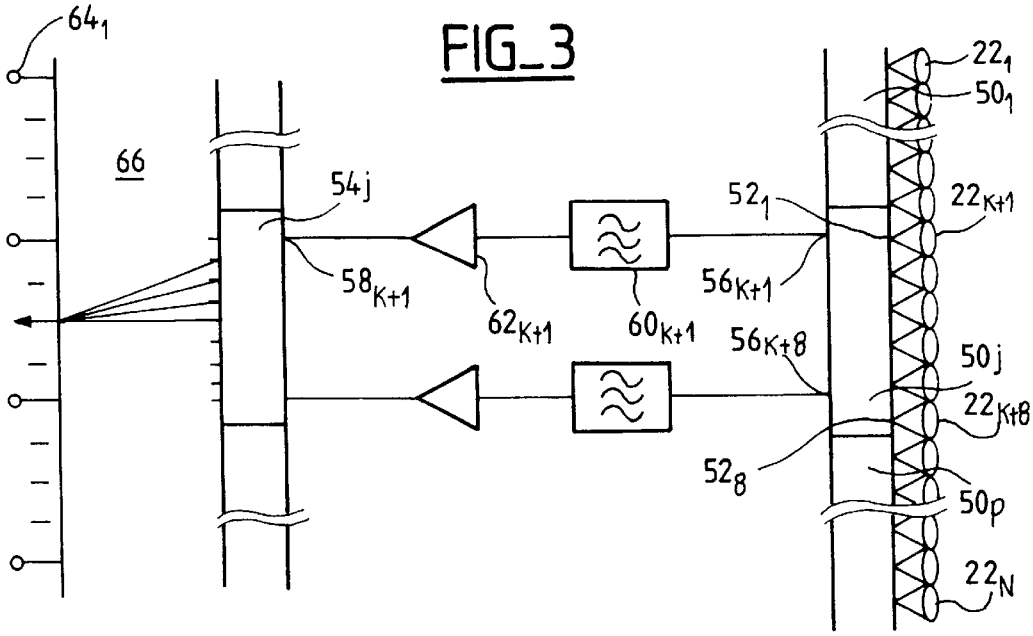
FIGS. 3 and 4 are diagrams showing parts of receive antennas according to the invention.

Like the antenna shown in FIG. 2, the receive antenna shown in FIG. 3 includes a reflector (not shown in FIG. 3)

and a plurality of radiating elements $\mathbf{22}_1, \ldots, \mathbf{22}_N$ disposed in the vicinity of the focal area of the reflector.

In the FIG. 3 example, the receive antenna includes a plurality of Butler matrices $50_1, \ldots, \mathbf{50}_j \ldots, \mathbf{50}_p$. The matrices are all identical, with the same number of inputs and outputs.

Each input receives the signal from a radiating element. Thus the Butler matrix $\mathbf{50}_j$ has eight inputs $\mathbf{52}_1$ to $\mathbf{52}_8$ and the input $\mathbf{52}_1$ receives the signal from the radiating element $\mathbf{22}_{k+1}$. The input $\mathbf{52}_8$ receives the signal from the radiating element $\mathbf{22}_{k+8}$. In one embodiment, the radiating elements $\mathbf{22}_{k+1}$ to $\mathbf{22}_{k+8}$ are all assigned to one area, i.e. to one beam. However, as indicated above, some of these radiating elements also contribute to forming other beams for adjacent areas.

Each output of the Butler matrix $\mathbf{50}_j$ is connected to a corresponding input of an inverse Butler matrix $\mathbf{54}_i$ via a filter and a low-noise amplifier. FIG. 3 shows only the low-noise amplifiers and the filters that correspond to the first output $\mathbf{56}_{k+1}$ of the matrix $\mathbf{50}_j$ and to the last output $\mathbf{56}_{k+8}$ of the matrix $\mathbf{50}_j$. Thus the output $\mathbf{56}_{k+1}$ of the matrix $\mathbf{50}_j$ is connected to the input $\mathbf{58}_{k+1}$ of the matrix $\mathbf{54}_j$ via a filter $\mathbf{60}_{k+1}$ and a low-noise amplifier $\mathbf{62}_{k+1}$ in series. The function of the filter $\mathbf{60}_{k+1}$ is to eliminate the send signals. The filter can be part of the matrix $\mathbf{50}_j$, especially if the matrix is implemented in waveguide technology.

The transfer function of the Butler matrix $\mathbf{54}_j$ is the inverse of that of the matrix $\mathbf{50}_j$. The matrix $\mathbf{54}_j$ has a number of inputs equal to the number of outputs of the matrix $\mathbf{50}_j$ and a number of outputs equal to the number of inputs of the matrix $\mathbf{50}_j$.

The outputs of the various inverse Butler matrices $\mathbf{54}_j$ are connected to the outputs of the beams $\mathbf{64}_1, \ldots, \mathbf{64}_s$ via a beam-forming network 66.

A Butler matrix is made up of 3 dB couplers, as described later; a signal applied to an input is distributed over all the outputs with phases shifted from one output to another by $2\pi/M$, where M is the number of outputs. The matrix $\mathbf{54}_j$ having a function which is the inverse of that of the matrix $\mathbf{50}_j$, a signal from a particular input of the matrix $\mathbf{50}_j$ is found, after filtering and amplification, at the corresponding output of the matrix $\mathbf{54}_j$.

Each output 56 of the matrix $\mathbf{50}_j$ delivers a signal representing all the input signals of the same matrix. This being the case, failure of one or more low-noise amplifier 62 will not lead to defective homogeneity of the beam for the corresponding area, but instead to a homogeneous reduction in power of all of the area(s) corresponding to the radiating elements $\mathbf{22}_{k+1}$ to $\mathbf{22}_{k+8}$.

It can be shown that on failure of one amplifier the signal at all the outputs of the matrix $\mathbf{54}_j$ is reduced by a factor of 20 log(1−1/M) dB, M being the order of the Butler matrix concerned, i.e. M=8 in this example. However, the degradation of the G/T parameter of the antenna is half this value, i.e. 10 log(1−1/M) dB, because the loss in the loads of the matrix $\mathbf{54}_j$ is negligible. This is because the dominant noise is that collected at the output of the low-noise amplifiers, and as an amplifier that has failed is no longer contributing to the noise, the total noise power is reduced by a factor 1−1/M.

Under these conditions (for $8^{th}$ order matrices), failure of one low-noise amplifier degrades G/T by −0.56 dB, or by −0.28 dB if M=6. The above figures correspond to the hypothesis that each amplifier consists of a pair of amplifiers, as described below with reference to FIG. 5, and the expression "amplifier failure" refers to only one amplifier of a pair.

Failure of one low-noise amplifier also degrades the isolation between the output signals. Accordingly, if the input signals are perfectly isolated before the failure, and the output signals are therefore also perfectly isolated, after the failure of one amplifier the isolation between two outputs is 20 log(M−1) dB, i.e. 17 dB if G=8 and 23.5 dB if G=16.

The values indicated above are theoretical values obtained by conventional calculation. However, if appropriate technologies are used, for example compact waveguide distributors, the losses and the errors are low and the results obtained in practice correspond to the calculations.

In one embodiment the inverse matrices $\mathbf{54}_j$ and the beam-forming network 66 constitute a single multilayer circuit. This is possible because the inverse matrices and the network 66 are preferably constructed from planar multilayer circuits using the same technology and can therefore be in the same package. The losses caused by circuits downstream of the low-noise amplifiers being less critical than those upstream of them, microstrip or triplate circuits can be used instead of waveguide circuits; microstrip and triplate circuits are more compact, but are subject to slightly greater losses than waveguide circuits, which is not a serious problem, as indicated above.

Figure 4:
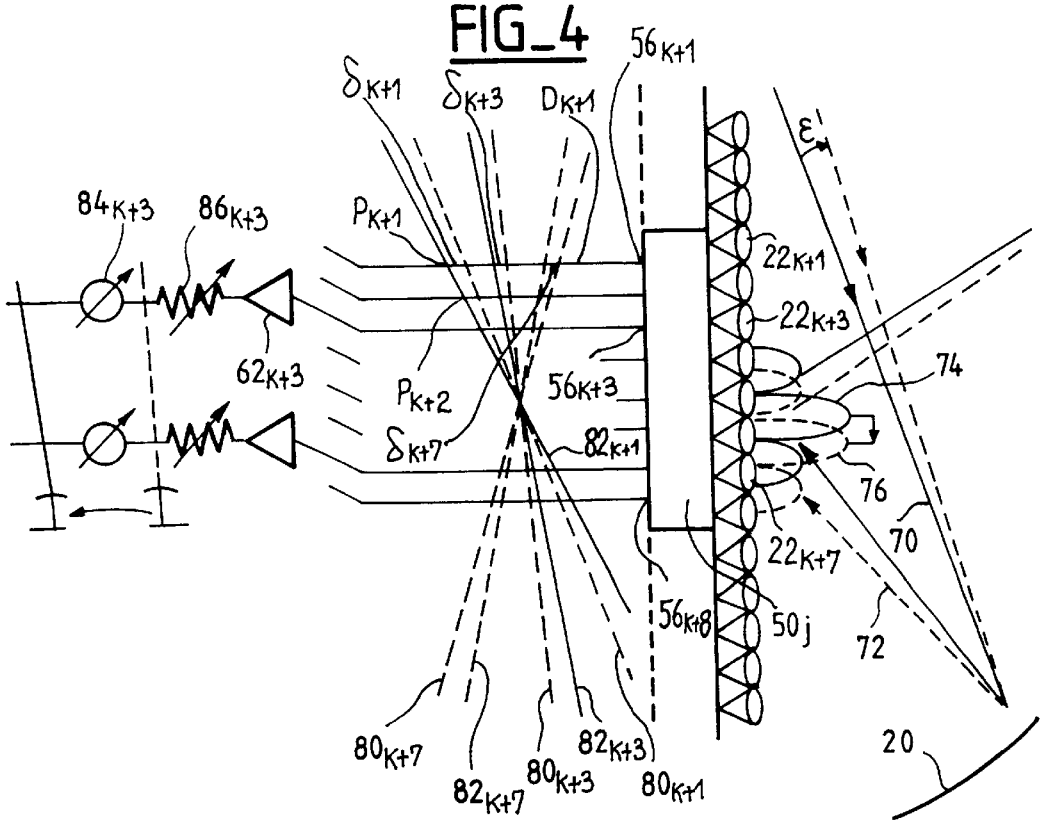

FIG. 4 shows a third embodiment of the invention exploiting Butler matrices to simplify the control of beam correction or modification. The figure shows in chain-dotted outline the correct radiating direction 70 relative to the antenna and in dashed outline the radiating direction 72 that is seen incorrectly by the antenna, for example because of instability of the satellite.

The energy in the radiating direction 70 corresponds to the full-line diagram 74 and the energy in the radiating direction 72 corresponds to the dashed-line diagram 76. It can therefore be seen that an incorrect orientation of the antenna shifts the radiation in the focal plane, and the radiating element intended to capture the greatest energy from a given direction receives that energy subject to strong attenuation. The shift therefore greatly reduces the gain and degrades the isolation.

To repoint the antenna, i.e. to correct its orientation, as described above with reference to FIG. 2, the prior art solution is to assign each radiating element a phase-shifter 42 and an attenuator 44 and to control the phase-shifters 42 individually. Also, the attenuators have a high dynamic range because they must be able to "turn on" or "turn off" some sources. Because of this constraint the low-noise amplifiers must have a high gain. Also, the number of radiating elements (sources) assigned to an area must be greater than the number of sub-areas. For example, if seven radiating elements provide the nominal diagram, to enable repainting requires at least one ring around the septet formed by those radiating elements. It would then therefore be necessary to provide 19 sources (rather than 7) for each access to an area. If the areas form a square mesh and four active sources are provided for each area, the number of accesses for an area is 16.

The invention simplifies correction of pointing or displacement of the areas on the ground compared to the solution shown in FIG. 2. It exploits the presence of the Butler matrices $\mathbf{50}_j$. The starting point is the fact that, at the output of the matrix $\mathbf{50}_j$, the phase front $\mathbf{80}_{k+1}$ is simply inclined to the desired phase front $\mathbf{82}_{k+1}$. This is because the signal of each beam is distributed across all the outputs of the corresponding matrix $\mathbf{50}_j$ with a given phase slope; the slopes corresponding to each input are separated by a fixed value, which is constant for a matrix of a given order. In this case, to effect the repainting, i.e. the required correction, it is sufficient to straighten the slope by providing a phase-shifter associated with each output of the matrix $\mathbf{50}_j$.

In FIG. 4, the straight line segments $\mathbf{80}_{k+1}$ and $\mathbf{82}_{k+1}$ represent the distribution of the phases at the outputs $\mathbf{56}_{k+1}$ to $\mathbf{56}_{k+8}$ for the signals coming from the radiating element $\mathbf{22}_{k+1}$. The straight line segments $\mathbf{80}_{k+3}$ and $\mathbf{82}_{k+3}$ correspond to the distributions of the phases over the outputs for the signal coming from the radiating element $\mathbf{22}_{k+3}$ and the straight line segments $\mathbf{80}_{k+7}$ and $\mathbf{82}_{k+7}$ correspond to the phases over all of the outputs for the signals supplied by the radiating element $\mathbf{22}_{k+7}$. In these diagrams, by convention, the distance between the output $\mathbf{56}_{k+1}$ and the intersection $P_{k+1}$ of the straight line segment $\mathbf{82}_{k+1}$ with the straight line segment $D_{k+1}$ linked to the output $\mathbf{56}_{k+1}$ represents the phase for that output of the signal coming from the radiating element $\mathbf{22}_{k+1}$. Similarly, the intersections of the straight line segment $\mathbf{82}_{k+1}$ with the corresponding straight line segments $D_{k+2}$, etc. provides the phases of the signals at the other outputs, again for the signal corresponding to the radiating element $\mathbf{22}_{k+1}$.

Accordingly, for the output $\mathbf{56}_{k+1}$, for example, to correct the phase front of the signal coming from a radiating element $\mathbf{22}_i$ from 80 to 82 it is necessary to apply a phase correction $d_{k+1}, d_{k+2}, \ldots, d_{k+8}$. However, it is found that the values $d_{k+1}, d_{k+2}, d_{k+3}$, etc. are the same. Thus a single phase-shifter $\mathbf{84}_{k+1}$, etc. is sufficient to correct the common value $d_{k+1}$, $d_{k+2}$, etc.

Figure 6:
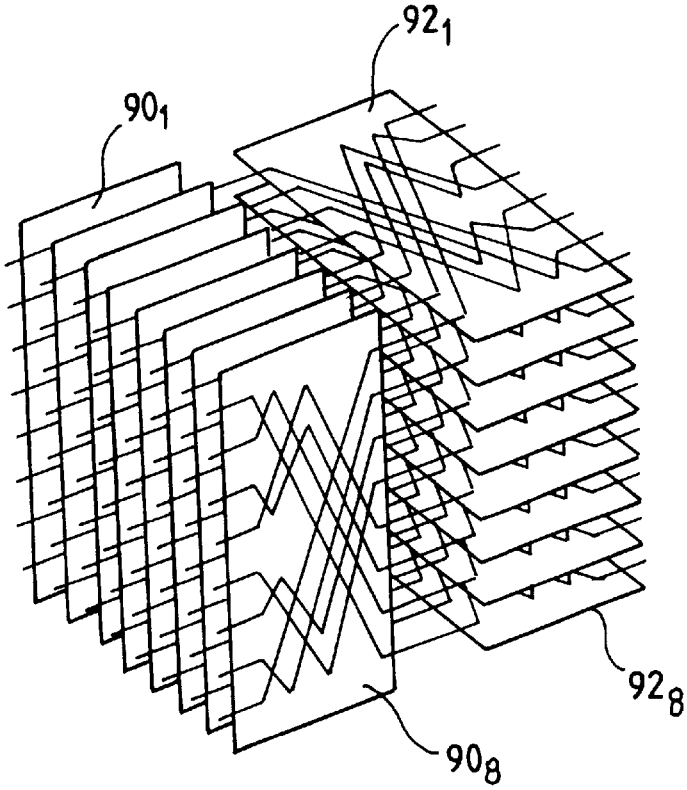
FIG. 6 shows a $64^{th}$ order Butler matrix.

Note that the correction effected by the Butler matrix $\mathbf{50}_j$ is effected in only a single plane, that of the figure. To effect a real correction, Butler matrices must be provided in another plane, for example a perpendicular plane, as shown in FIG. 6, to be described later.

In the present example, a phase-shifter 84 of this kind is provided downstream of the low noise amplifier 52. Thus the phase-shifter $\mathbf{84}_{k+1}$ in FIG. 4 is connected to the output of the amplifier $\mathbf{62}_{k+1}$ via an attenuator $\mathbf{86}_{k+1}$ and the output of the phase-shifter $\mathbf{84}_{k+1}$ is connected to the corresponding input of the inverse matrix $\mathbf{54}_j$.

In this embodiment, the variable attenuators 86 are used to equalize the gain of the amplifiers 62. They also provide compensation in the event of failure of one or more low-noise amplifiers connected to a matrix coupled to the matrix $\mathbf{50}_j$, as explained later.

In the present example, high-pass filters are provided in the Butler matrices $\mathbf{50}_j$ to prevent the send frequencies interfering with the receive frequencies. They are waveguides, for example, with cut-off frequencies between the receive band and the send band.

In the present example, as described with reference to FIG. 3, the inverse Butler matrices $\mathbf{54}_j$ can also be integrated into the beam-forming network 66.

Figure 5:
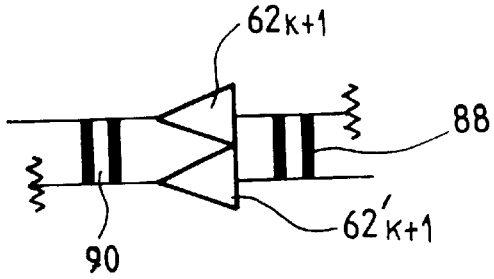
FIG. 5 is a diagram of a variant of part of an antenna according to the invention.

In the variant shown in FIG. 5, the low-noise amplifiers 62 are associated in pairs by means of 90° couplers. To be more precise, the amplifier $\mathbf{62}_{k+1}$ is associated with the amplifier $\mathbf{62}_{k+2}$ and a 90° coupler 88 connects the inputs of the amplifiers and a 90° coupler interconnects the outputs of the amplifiers. Thus, in the event of failure of one amplifier, the loss is 0.28 dB with an $8^{th}$ order Butler matrix, which in the absence of the features shown in FIG. 5, is the same as the loss if the Butler matrices are $16^{th}$ order matrices. This is because implementing each amplifier associated with an output of a Butler matrix as a pair of amplifiers halves the power loss in the event of failure of a single amplifier of the pair, because the other amplifier of the pair is still operating. In other words, this has the same effect as doubling the order of the Butler matrices.

More generally, and still with the object of reducing the effect of failure of an amplifier, each output can be associated with a plurality of amplifiers in parallel. In this case, to facilitate splitting followed by recombination, the number of amplifiers associated with each output is a power of 2.

Although a plurality of matrices $\mathbf{50}_j$ has been used in the examples described up until now, it is possible to provide a single $M^{th}$ order Butler matrix, where M is the number of radiating elements. However, available space constraints on board a satellite prevent implementing this kind of Butler matrix in a single plane when the number of radiating elements is high. In this case it is necessary to employ a two-dimensional Butler matrix, as shown in FIG. 6, which shows a $64^{th}$ order matrix comprising a first layer of eight Butler matrices $\mathbf{90}_1$ to $\mathbf{90}_8$ and a second layer of Butler matrices $\mathbf{92}_1$ to $\mathbf{92}_8$ disposed perpendicularly to the matrices 90.

Implementing this kind of two-dimensional matrix is complex and the matrix can also be subject to losses compromising the noise temperature of the antenna. However, this kind of two-dimensional matrix enables simultaneous repainting in two orthogonal planes and reduces the impact of a failure by interconnecting a greater number of low-noise amplifiers.

Generally speaking, to be able to effect a correction in two different planes it is not essential for the matrices 90 and 92 to be in two perpendicular planes. It is sufficient for them to be in two planes in different directions with a sufficient offset. In one example the directions are offset by 60° to facilitate connection to an array in which the centers of adjacent sources form equilateral triangles.

$8^{th}$ order and $16^{th}$ Butler matrices are constructed from $4^{th}$ order Butler matrices.

Figure 7:
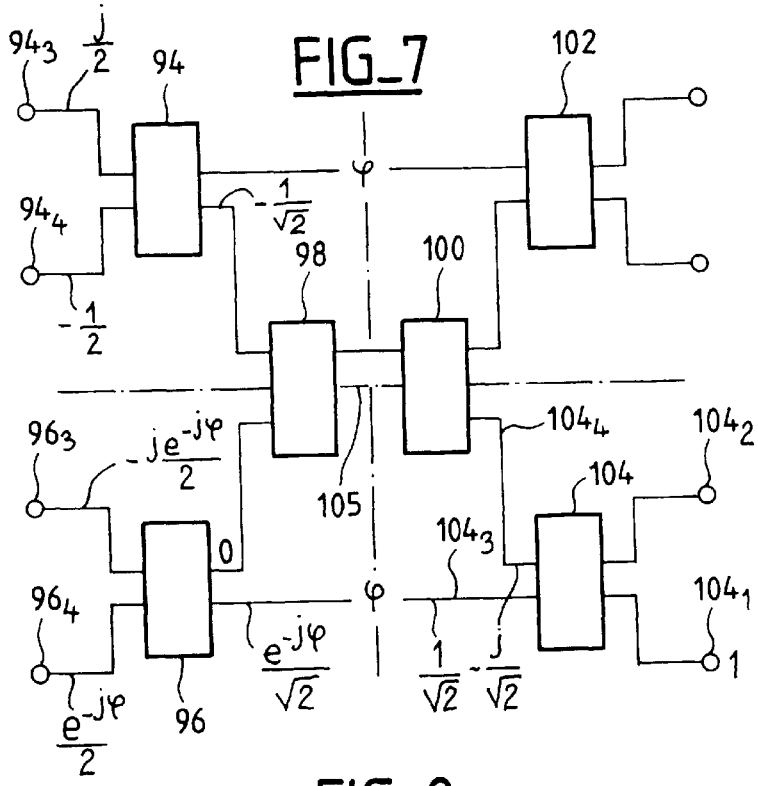
FIG. 7 is a diagram of a $4^{th}$ order Butler matrix.

FIG. 7 shows a $4^{th}$ order Butler matrix which includes six 3 dB couplers with two input couplers 94, 96, two output couplers 102, 104 and two intermediate couplers 98 and 100. In a variant, not shown, crossovers are provided instead of the intermediate couplers 98 and 100; crossovers are difficult to implement in waveguide technology, however.

A 3 dB coupler, for example the input coupler 104, has two inputs $\mathbf{104}_1$ and $\mathbf{104}_2$ and two outputs $\mathbf{104}_3$ and $\mathbf{104}_4$. The power of a signal applied to one input, for example the input referenced $\mathbf{104}_1$, is distributed over the two outputs $\mathbf{104}_3$, $\mathbf{104}_4$ with a phase-shift of $\pi/2$ between the two output signals. Accordingly, as shown in FIG. 7, a signal S at the input $\mathbf{104}_1$ becomes the signal $S/\sqrt{2}$ at the output $\mathbf{104}_3$ and the signal $-jS/\sqrt{2}$ at the output $\mathbf{104}_4$. A signal S' at the input $\mathbf{104}_2$ corresponds to a signal $S'/\sqrt{2}$ at the output $\mathbf{104}_4$ and a signal $-jS/\sqrt{2}$ at the output $\mathbf{104}_3$.

The signal at the input $\mathbf{104}_1$ is obtained at the four outputs of the $4^{th}$ order Butler matrix, i.e. the outputs $\mathbf{94}_3$, $\mathbf{94}_4$ and $\mathbf{96}_3$, $\mathbf{96}_4$ of the respective couplers 94 and 96. The signal jS/2 is obtained at the output $\mathbf{94}_3$, the signal −S/2 at the output $\mathbf{94}_4$, the signal $-jSe^{-j\Phi}/2$ at the output $\mathbf{96}_3$ and the signal $Se^{-j\Phi}/2$ at the output $\mathbf{96}_4$. The constant phase f is introduced by a phase-shifter 105 between the couplers 98 and 100. The phase-shifter is set up to compensate the differences between the guide lengths in the central and outside channels; accordingly, the matrix provides a regular slope at the phases of the signals at the outputs.

With a $4^{th}$ order Butler matrix, the phases of the output signals vary by increments of 90°. With an $8^{th}$ order Butler matrix the increment is 45°.

An $8^{th}$ order Butler matrix 120 or 130 (FIG. 8) is produced from two $4^{th}$ order matrices 122 and 124, and the outputs of the two $4^{th}$ order matrices are combined by four 3 dB couplers $\mathbf{126}_1$, $\mathbf{126}_2$, $\mathbf{126}_3$, $\mathbf{126}_4$.

A $16^{th}$ order Butler matrix (FIG. 8) is produced from two $8^{th}$ order matrices 120 and 130 and the outputs of the matrices 120 and 130 are combined by eight 3 dB couplers $\mathbf{132}_1$ to $\mathbf{132}_8$.

Figure 8:
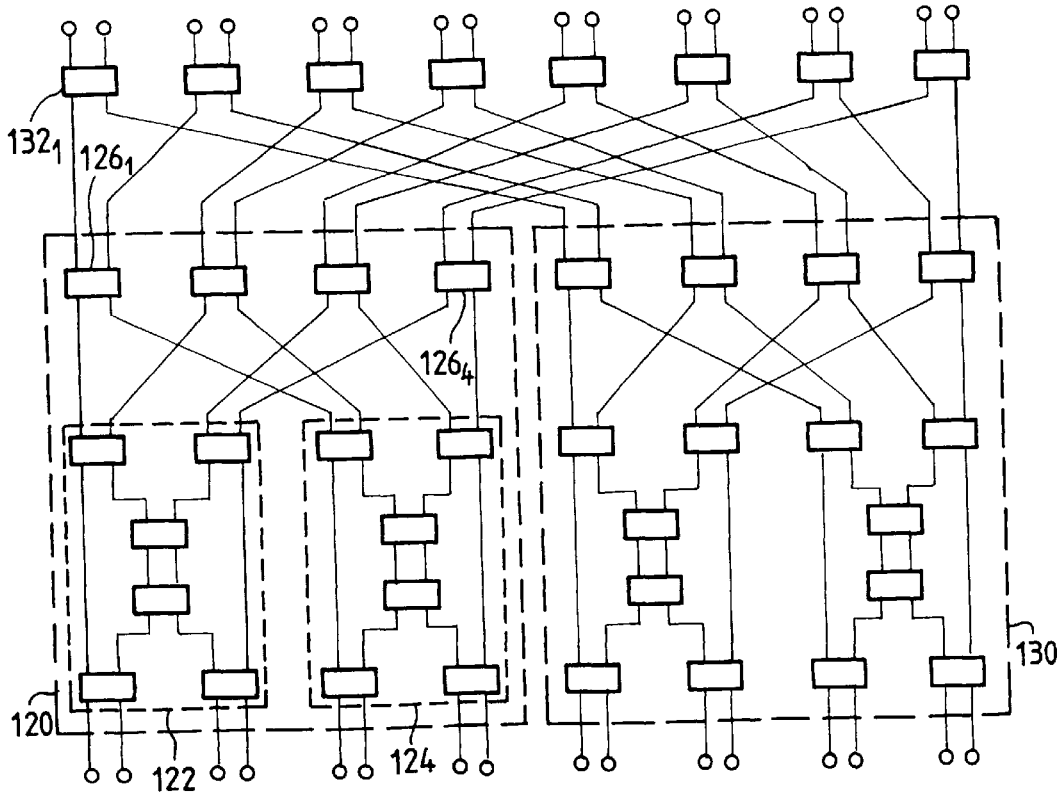
FIG. 8 is a diagram of a $16^{th}$ order Butler matrix.

Note that the crossovers of the rows of the $16^{th}$ order matrix shown in FIG. 8 can be replaced by head-to-tail couplers analogous to the couplers 98 and 100 of the $4^{th}$ order matrix shown in FIG. 7. This is known in the art.

In the present example, the Butler matrices 50 employ the "compact waveguide distributor" technology. In this case it is possible to integrate filtering to prevent the low-noise amplifiers from being delinearized by out-of-band interference signals into the matrices. This refers in particular to filtering to reject the send frequencies which, because of the very high send power, are necessarily re-injected into the nearby receive antennas.

Figure 9:
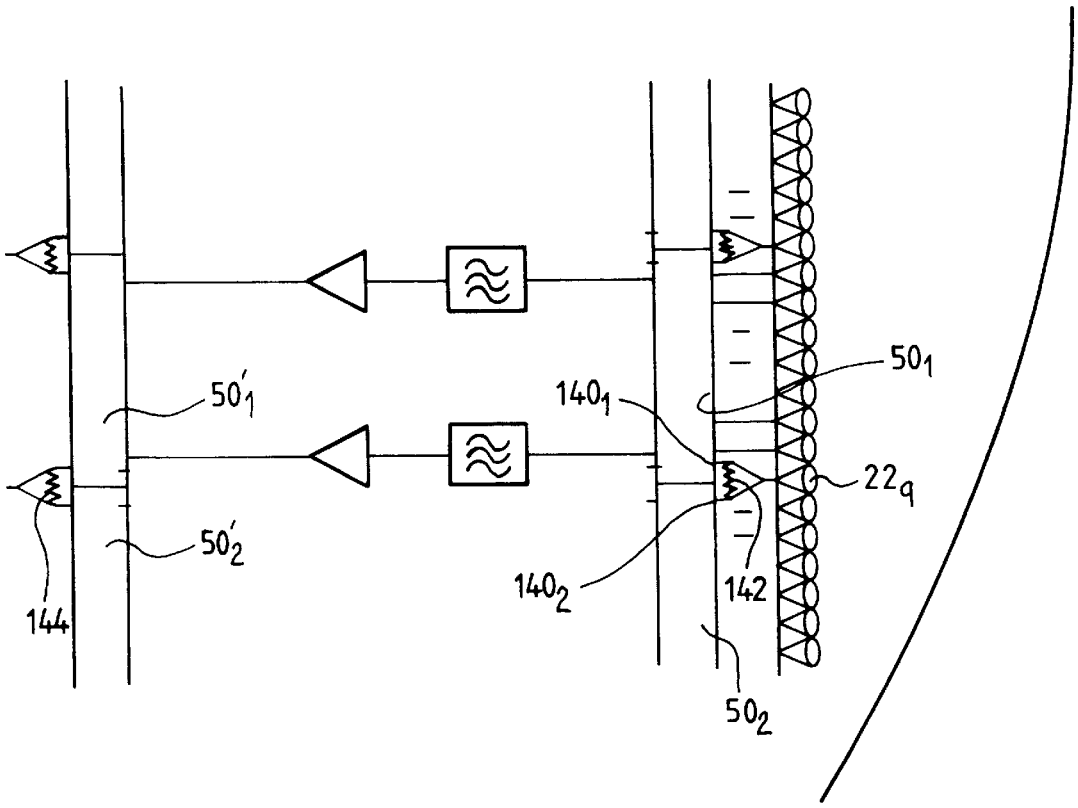
FIG. 9 is a diagram of a receive antenna showing other features of the invention.

It is preferable for each Butler matrix $\mathbf{50}_j$ to correspond to one or more areas and for the other matrices not to be operative for the areas associated with the Butler matrix $\mathbf{50}_j$. However, it is not always possible to satisfy this condition, because each source generally contributes to the formation of a plurality of adjacent areas. In this case, a source $\mathbf{22}_q$ (FIG. 9) which must be associated with two adjacent matrices $\mathbf{50}_1$, $\mathbf{50}_2$ is connected to the respective inputs $\mathbf{140}_1$ and $\mathbf{140}_2$ of the matrices $\mathbf{50}_1$ and $\mathbf{50}_2$ via a 3 dB coupler 142. An identical coupler 144 combines the corresponding outputs of the inverse matrices $\mathbf{50'}_1$ and $\mathbf{50'}_2$.

The couplers 142, 144 also limit degradation of the signal coming from a source shared between two matrices in the event of failure of a low-noise amplifier associated either with the matrices $\mathbf{50}_1$, $\mathbf{50'}_1$, or with the matrices $\mathbf{50}_2$, $\mathbf{50'}_2$. This is because the signal picked up by any such source is split equally between two matrices. Accordingly, only the part affected by a failure is operative.

Although these couplers reduce (by half) the imbalance caused by a failure in a matrix, the remaining imbalance in the event of a failure is generally unacceptable. This is why, instead of or in addition to the couplers 142, 144, in the event of failure of a low-noise amplifier associated with one matrix, for example the matrix referenced $\mathbf{50}_1$, the output signals of the other matrix $\mathbf{50}_2$ are attenuated by an amount that balances the output signals of the matrices $\mathbf{50}_1$ and $\mathbf{50}_2$ by means of the attenuators 86 shown in FIG. 4. The attenuation must be by 20 log(1−1/M) dB for inputs or outputs with no 3 dB coupler or 10 log(1−1/M) dB for outputs connected to the 3 dB couplers 144.

The attenuation is applied automatically after a failure is detected. Failure of a low-noise amplifier is detected by monitoring its power supply current, for example, or using a diode detector downstream of the low-noise amplifier.

Note that in the present example the attenuators 86 (FIG. 4) have a small dynamic range, less than 3 dB. This is because their dynamic range is principally determined by their function of equalizing the gains of the various low-noise amplifiers when the antenna is installed. For this equalization the maximum dynamic range is 2.5 dB. Moreover, the compensation required to rebalance the outputs of a matrix when an amplifier of the adjacent matrix has failed is 0.28 dB.

Although only a receive antenna has been described, it goes without saying that the invention also applies to a send antenna whose structure is analogous but with the opposite configuration, using power amplifiers instead of low-noise amplifiers.

What is claimed is:

1. A multi-beam receive or send antenna for a geosynchronous satellite of a telecommunications system intended to cover a territory divided into a plurality of areas, a beam intended for each of said plurality of areas being defined by a plurality of radiating elements, or sources, disposed in the vicinity of the focal plane of a reflector, the antenna including means for modifying the locations of the areas or for correcting antenna pointing errors, the antenna including a first series of first Butler matrices, disposed in parallel planes, and a second series of first Butler matrices also disposed in parallel planes but in a direction different from that of the first series, to enable the displacement of the beams over said areas or the correction of said pointing errors in two different directions, and therefore in all directions of the area covered by the antenna, each input of each first Butler matrix of said first series being connected to a radiating element, and each output of each first Butler matrix of said second series being connected to a corresponding input of an inverse Butler matrix via an amplifier, in a set of amplifiers, and a phase-shifter, wherein said means for modifying includes said phase-shifter, the outputs of the inverse Butler matrices being associated with a beam-forming network, and wherein the phase-shifters displace the beam over a plurality of areas or correct said pointing errors, each first Butler matrix and inverse Butler matrix distributing the energy received by each radiating element over said set of amplifiers so that the effect of failure of one amplifier is uniformly distributed over all the output signals, at least one radiating element being connected to an input of one first Butler matrix of said first series and to an input of another first Butler matrix of said first series.

2. An antenna according to claim 1, wherein each Butler matrix has the same number of inputs and outputs.

3. An antenna according to claim 1, wherein there is an attenuator for equalizing the gains of the amplifiers in series with each amplifier and each phase-shifter.

4. An antenna according to claim 1, wherein the directions of the first and second series of first Butler matrices are orthogonal.

5. An antenna according to claim 1, wherein the radiating element associated with the one and the other Butler matrices is connected to the inputs of those two matrices by a 3 dB coupler, and wherein there is a similar coupler at the corresponding outputs of the inverse Butler matrices.

6. An antenna according to claim 1, wherein each amplifier and phase-shifter includes an attenuator which attenuates the output signals of the other Butler matrix in order to homogenize the output signals of the one and the other matrices in the event of failure of an amplifier associated with a matrix.

7. An antenna according to claim 1, wherein amplifiers in parallel, associated by 90° couplers, are provided between each output of each first Butler matrix of said second series and each corresponding input of the inverse Butler matrix.

8. An antenna according to claim 1, wherein the phase-shifters modify the slope of the phase front of each first Butler matrix to correct an angular deviation and simultaneously repoint all the beams.

9. An antenna according to claim 1 and intended for reception, wherein each first Butler matrix includes a filter system for eliminating the send frequency bands.

10. An antenna according to claim 1, wherein the inverse Butler matrix and the beam-forming network form a single system.

11. An antenna according to claim 3, wherein the attenuator in series with each amplifier has a dynamic range of less than 3 dB.

12. An antenna according to claim 1, wherein the Butler matrices are 8th order matrices or 16th order matrices.

* * * * *